United States Patent [19]

Klier

[11] 3,981,162

[45] Sept. 21, 1976

[54] CONTINUOUS TREATMENT OF TEXTILE MATERIALS

[76] Inventor: Shimon Klier, 4 Simtat Magal, Savyon, Israel

[22] Filed: Nov. 26, 1973

[21] Appl. No.: 418,870

[30] Foreign Application Priority Data

Nov. 29, 1972 Israel ..... 40966

[52] U.S. Cl. ..... 68/5 E; 68/9; 68/184; 118/419

[51] Int. Cl.[2] ..... D06B 3/04; D06B 3/24; D06B 23/18

[58] Field of Search ..... 8/151, 151.2, DIG. 19; 68/177, 175, 179, 180, 181 R, 184, 194, 199, 27, 5 E, 9, 178; 118/419, 420

[56] References Cited

UNITED STATES PATENTS

| | | | |
|---|---|---|---|
| 2,458,394 | 1/1949 | Luboshez | 8/151 |
| 2,641,121 | 6/1953 | Belcher | 68/9 X |
| 3,128,206 | 4/1964 | Dungler | 68/5 E X |
| 3,698,212 | 10/1972 | Ameling | 68/184 |

*Primary Examiner*—Philip R. Coe
*Attorney, Agent, or Firm*—Browdy and Neimark

[57] ABSTRACT

An apparatus for the treatment of a textile material comprising at least one treatment zone intermediate upstream and downstream treatment zones wherein successive zones are separated from each other by respective sealing zones. The textile material is propelled through the treatment zones by means of a forced circulation of a sealing liquid that flows through the sealing zones.

7 Claims, 2 Drawing Figures

Figure 1:
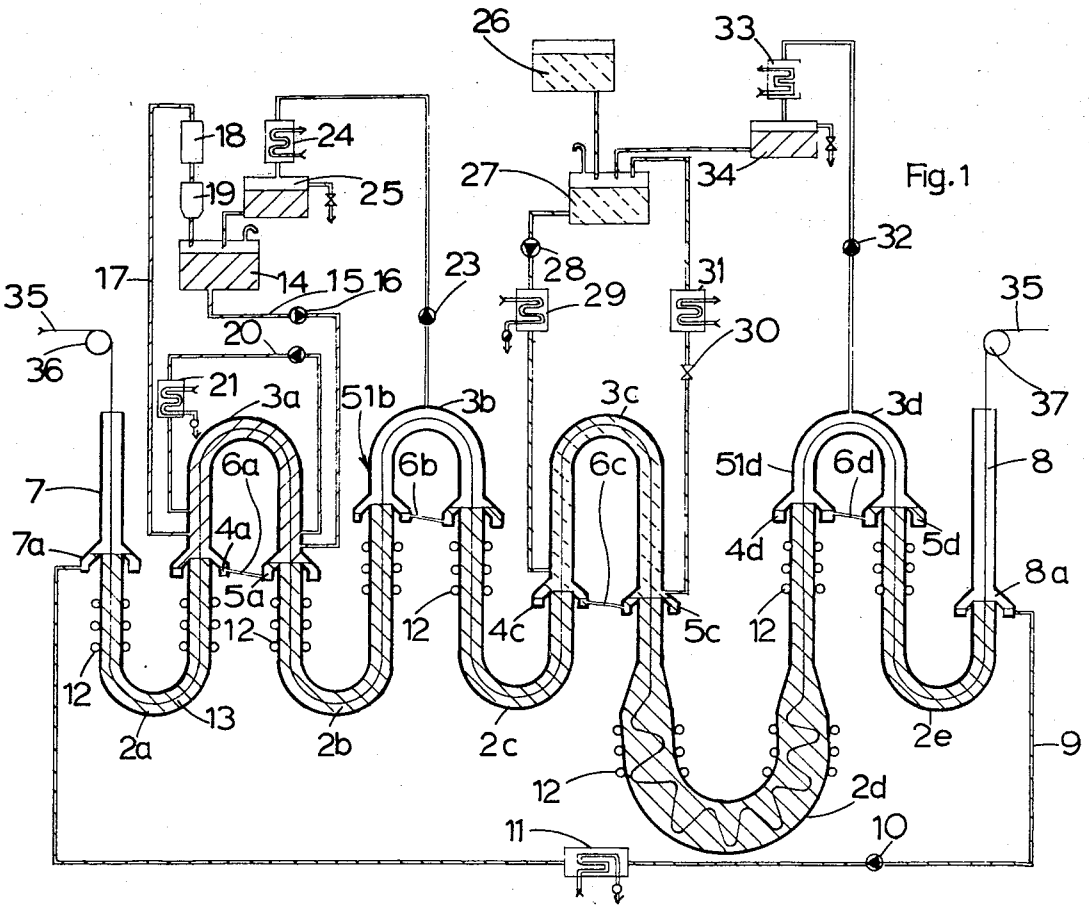

35
37
8
8a
9
5d
2e
3d
6d
32
2d
10
33
34
51d
4d
12
31
30
5c
3c
6c
29
28
26
27
4c
2c
11
23
3b
6b
51b
2b
25
24
16
15
14
20
3a
6a
4a
5a
18
19
21
13
2a
17
36
7
7a

CONTINUOUS TREATMENT OF TEXTILE MATERIALS

This invention relates to the treatment of textile materials within which term is included yarns, woven or knitted fabrics and the like.

As used in the present specification, the term "treatment" includes any form of treatment of a textile material in a wet or dry atmosphere under atmospheric pressure or non-atmospheric pressure conditions where, during treatment the textile is to be maintained isolated from upstream or downstream zones through which the textile passes.

The invention is particularly but not exclusively concerned with the treatment, as hereinbefore defined, of textile materials which treatment is inherent in the various stages of a continuous dyeing process. These stages may comprise, for example, the scouring, impregnating, steaming or drying stages.

In some or each of these stages the requirement may arise that the requisite treatment be carried out in complete isolation from what is taking place upstream or downstream of the particular stage. This can be required, for example, where successive stages are carried out at differing pressures. This may also be required where successive stages are carried out in differing ambient atmospheres whose intermixture must be prevented. Such a requirement particularly arises with the so-called solvent dyeing process seeing that the solvent materials usually employed are highly toxic and must not be allowed to escape from the treatment zone and are furthermore extremely expensive and therefore require the taking of precautions so as to prevent loss.

Furthermore, in many forms of treatment of textile materials difficulties are encountered in displacing the material through the treatment zones without at the same time deleteriously affecting the material. Thus, for example, in the continuous dyeing of textile materials, the continuous displacement of such materials, is in conventional processes effected as a result of a traction force exerted on the materials and such a traction force can lead to undesirable stretching, particularly in the case of knitted materials.

It is an object of the present invention to provide an apparatus for the continuous treatment of textile materials in which the above referred to desiderata are substantially achieved and disadvantages wholly or partially reduced.

According to an aspect of the present invention there is provided apparatus for the treatment of textile material comprising a treatment zone, an inlet and an outlet of said treatment zone, respective enclosures communicating with said inlet and outlet of said treatment zone, seal liquid located in said enclosures, and circulating means for continuously circulating said seal liquid from a downstream enclosure to an upstream enclosure so as to carry with it the textile material thereby causing the material to pass continuously through the treatment zone.

Said liquid seal can be constituted by a liquid metal or a molten salt or any other liquid or liquid like material which whilst remaining chemically inert to the substances with which it comes into contact nevertheless fulfills its sealing and carrier requirements.

Effectively the purpose of the liquid seals is, on the one hand to separate the treatment zone from zones of differing pressures and/or ambient atmospheres and, on the other hand, to serve as the means of displacing the textile material through the treatment zone thereby obviating the stretching which was characteristic of conventional methods.

A clear advantage of the apparatus in accordance with the present invention, particularly when used in continuous dyeing processes resides in the reduction of the so-called "liquor ratio" being the ratio of the volume of the ambient treating media to the bulk of the material being treated. Such a reduction contributes to a significant economy in the quantities of treating media employed.

Figure 2:
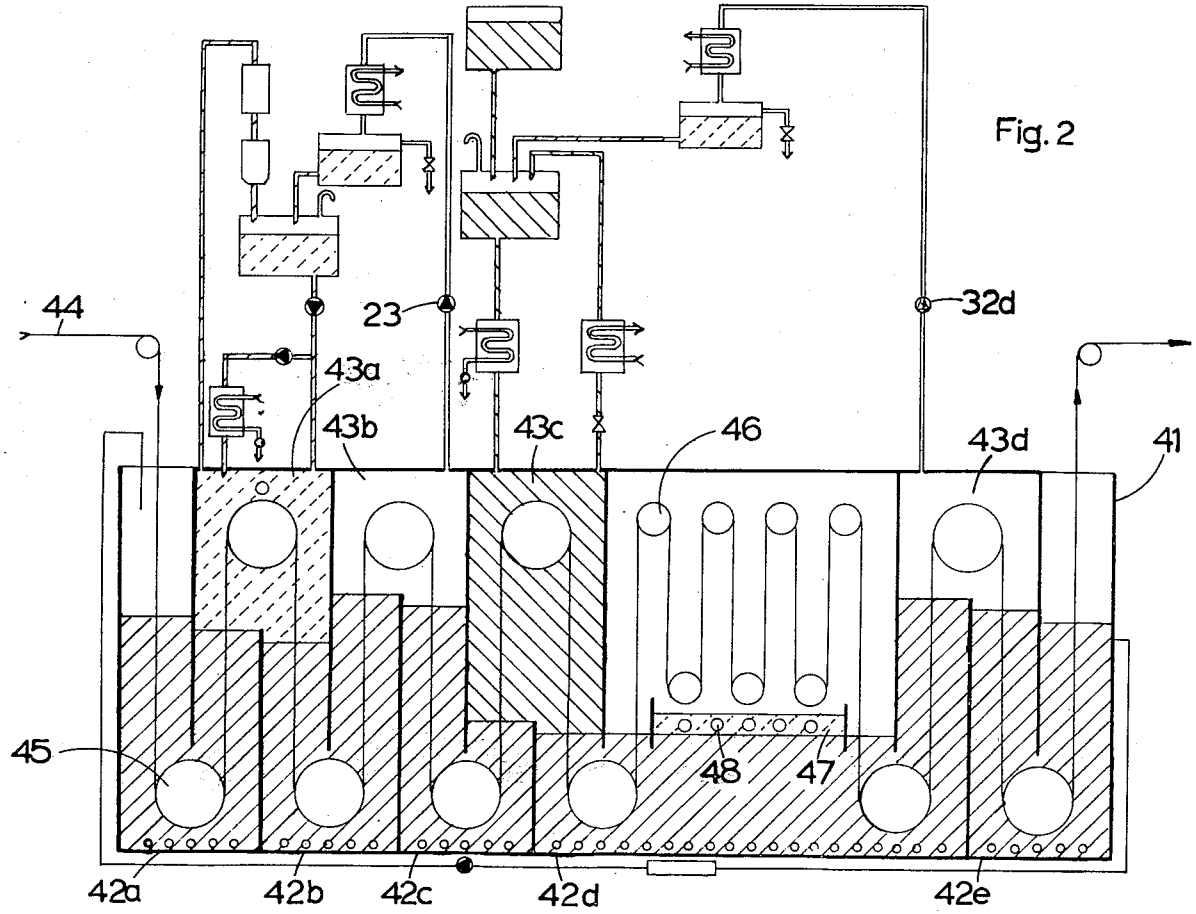

For a better understanding of the present invention and to show how the same can be carried out in practice, reference will now be made to the accompanying drawings, in which:

FIGS. 1 and 2 show schematically and respectively the application of the invention to the solvent dyeing of textiles in respective rope and open width form.

As seen in FIG. 1 of the drawings the dyeing installation is of substantially sinusoidal shape and comprises a series of successive, tubular U-shaped enclosures, successive upright U-shaped enclosures 2*a* to 2*e* being respectively coupled together by intermediate, inverted U-shaped enclosures 3*a* to 3*d*.

The vertical limbs of successive inverted enclosures 3*a* to 3*d* communicate with the appropriate limbs of the upright enclosures 2*a* to 2*e* via annular channels 4*a*, 5*a*, 4*b*, 4*c*, 5*c*, 4*d*, 5*d*. In their turn, the channels 4*a* and 5*a* communicate via an inclined conduit 6*a* and in a similar way the channels 4*d* and 5*d*, 4*c*, 5*c* and 4*d*, 5*d* communicate via respective inclined conduits 6*b*, 6*c* and 6*d*.

The outermost limb of the upright enclosures 2*a* communicates with an upright inlet conduit 7 via an annular channel 7*a* whilst the extreme limb of the enclosure 2*e* communicates with an upright outlet conduit 8 via an annular channel 8*a*. The channels 8*a* and 7*a* communicate via a conduit 9, a pump 10 and a heat exchanger 11. The limbs of the upright enclosures 2*a* to 2*e* are respectively provided with heating coils 12.

Each of the upright enclosures 2*a* to 2*e* are filled with a liquid alloy 13 which fills the respective enclosure up to the level of the respective annular channels. The provision of the conduit 9, pump 10 and bypass 6 and the maintenance, as described below, of non-atmospheric pressures in the enclosures 3*a* – 3*d*, allow for the continuous circulation of the liquid alloy (which is maintained in liquid form by means of the heating coils 12) so that the liquid alloy flows through the upright enclosures 2*a* to 2*e* in a direction from left to right as seen in the figure.

A solvent material is arranged to flow from a main solvent reservoir 14 via conduit 15 and pump 16 under pressure into the right-hand limb of the enclosure 3*a* so as to fill the enclosure 3*a* with solvent liquid under pressure, the solvent circulates in the enclosures 3*a* and emerges via the conduit 17 so as to be returned to the reservoir 14 for recirculation having first of all passed through a filter 18 and a distillation tower 19. In order to ensure that the solvent material in the enclosure 3*a* is always maintained at a suitably elevated temperature some of this solvent material is circulated via a bypass conduit 20 and a heat exchanger 21 in which it undergoes heating.

The enclosure 3*b* is provided with a live steam inlet 51*b* and communicates with the inlet of a vacuum pump 23, the outlet of which communicates via a condenser 24 and a water separator 25 with the solvent reservoir 14. A dye stuff reservoir 26 feeds a dyestuff sump 27 whose outlet communicates, via a pump 28 and heat exchanger 29 with an inlet to the enclosure 3*c*. An outlet of the enclosure 3*c* communicates via a pressure regulating valve 30 and heat exchanger 31 with an inlet to the dyestuff sump 27.

The enclosure 3*d* is also provided with a live steam inlet 51*d* and communicates with the inlet of a vacuum pump 32, the outlet of which communicates via a condenser 33, water separator 34 with a further inlet to the dyestuff sump 27.

Textile material 35 in rope form is introduced into the inlet conduit 7 passing over an inlet roller 36 and emerges from the outlet conduit 8 over an outlet roller 37.

As indicated above the textile material in rope form is continuously drawn through the installation as a result of the circulation of the sealing fluid through the upright U-shaped enclosures. This form of displacement imparted to the textile material ensures that the latter passes through the installation with insignificant stretching seeing that the material travels together with the sealing fluid and not with respect to the sealing fluid. This factor is of very considerable significance in the continuous dyeing of textile materials seeing that, otherwise, the continuous displacement of such materials can only be effected as a result of a traction force exerted on the materials and such a traction force can lead to undesirable stretching, particularly in the case of knitted materials. This drawback has hitherto militated against the use of continuous dyeing processes in the case of knitted material.

Furthermore, the presence of the liquid metal seals in the upright U-shaped enclosures not only serves on the one hand as a seal for the inverted U-shaped enclosures and on the other hand as a transport medium for transporting the material through the installation, but also plays a positive role in the treatment of the material itself by heating it.

Thus, the incoming material 35, prior to passing into the enclosure 3*a* where it is subjected to solvent scouring passes through the liquid seal in the enclosure 2*a* where it is heated. After being subjected to solvent scouring in the enclosure 3*a* the material passes into the vacuum enclosure 3*b* where the material is subjected to drying under vacuum under the influence of the live steam, expressed solvent being removed, together with any aqueous solution by means of vacuum pump 23 for subsequent return to the solvent reservoir 14.

The dried material passes through the seal enclosure 2*c* and having been subjected to vacuum treatment in the enclosure 3*b* arrives in the dyeing enclosure 3*c* it is in an ideal state for impregnation.

As can be seen, the enclosure 2*d* is substantially wider and of greater extent than the remaining enclosures and this allows for the textile material to acquire an undulating shape therein and allows for the material to remain in contact with the heated seal liquid for an increased duration of time, it being appreciated that in all cases the material passes through the liquid seal whilst the latter is at an elevated temperature.

Finally, the material enters the enclosure 3*d* where it is subjected to final drying under vacuum conditions and under the effect of the live steam, residual solvent and water being removed, the former finding its way to the dyestuff sump 27. The now dried material passes through the final seal enclosure 2*e*.

The installation just described has been specially designed for use with textile in rope form. The similar installation now to be described with reference to FIG. 2 of the drawings is designed for textiles in open width form.

In this installation the solvent and dyestuff feed system is identical with that shown in FIG. 1 and will be accorded the same reference numerals and will not be described in any further detail.

The installation itself consists of an elongated vat 41 in which successive, alternatingly upper and lower partitions combine to define successive enclosures 42*a*, 42*b* and 42*e* substantially corresponding to the upright U-shaped enclosures 2*a* to 2*e* shown in FIG. 1 and enclosures 43*a* to 43*d* substantially corresponding to the inverted U-shaped enclosures 3*a* to 3*d* shown in FIG. 1.

The enclosure 42*a* to 42*e* are filled with a liquid seal preferably liquid metal, the enclosure 43*a* is filled with a recirculating solvent, the enclosure 43*b* is evacuated by the vacuum pump 23, the enclosure 43*c* is the dye impregnating enclosure whilst the enclosure 43*d* is again coupled to a vacuum pump 32. The open width of fabric 44 passes through each of the enclosures successively over and under appropriate rollers 45 employed for this purpose. The right hand limb of the enclosure 42*d* serves as a vaporizing enclosure and in this enclosure the textile material, after having emerged from the dye impregnating enclosure 43*c*, successively passes around upper and lower rollers 46 in a solvent saturated atmosphere, the solvent being provided from a solvent sump 47 which is appropriately heated by heater coil 48.

It will be realized, of course, that where a similar installation is used for aqueous dyeing rather than for solvent dyeing the right-hand limb of the enclosure 42*d* can be provided with an aqueous sump and serves as a steaming enclosure.

The operation and functioning of the installation just described with reference to FIG. 2 is substantially identical with that described with reference to FIG. 1, transport of the open length material being effected as a result of the through-flow of liquid seal from enclosure to enclosure, the liquid seal in the last enclosure 42*e* being pumped back to the first enclosure 42*a*.

It will be readily appreciated that whilst the invention has been specifically described with reference to a full scale dyeing installation the invention is equally applicable to each of the separate units of the installation or to any other type of installation wherein the specific requirement of treatment as outlined above exists.

Furthermore, whlist in the specific example given above the liquid seal has been effected by means of a liquid metal, other liquid materials can be equally employed provided that they are inert with respect to the surrounding materials. Whilst in the present example the liquid seal is constituted by a material of higher density than the solvent or dyestuff, it will be appreciated that a liquid seal could be used which is of lower density than the surrounding materials with appropriate adjustment of the installation.

Finally, whilst in the specific embodiments described above, transport of the textile material is effected by displacement of a liquid material which at the same time serves as a liquid seal in accordance with a further aspect of the present invention, a suitable liquid material which is inert with respect to the surrounding materials (whether the textile material to be treated or any of the treating materials) can be employed for the sole purpose of transporting the textile material to be treated as a result of its own displacement.

I claim:

1. Apparatus for the continuous treatment of generally continuous textile material, comprising:

at least one treatment zone having defined ingress and egress;

inlet and outlet sealing zones disposed in fluid communication with the respective ingress and egress of said treatment zone, a sealing liquid flow path effecting communication betwen said sealing zones while bypassing said treatment zone, said sealing zones containing sealing liquid which is substantially inert with respect to said material and any treatment substance; and propelling means for propelling said textile material through said at least one treatment zone and constituted by means for causing forced circulation of said sealing liquid through said sealing zones and said sealing liquid flow path in a predetermined direction thereby entraining said textile material into movement in said direction.

2. Apparatus according to claim 1 wherein said at least one treatment zone contains a treatment liquid and further comprising means to maintain said sealing liquid at an elevated temperature with respect to said treatment liquid and to provide heating of said textile web.

3. Apparatus according to claim 1 wherein said at least one treatment zone comprises a plurality of treatment zones.

4. Apparatus according to claim 3 wherein said plurality of treatment zones comprise inverted U-shaped conduits and said sealing zones comprise upright U-shaped conduits.

5. Apparatus according to claim 3 wherein said plurality of treatment zones and sealing zones are defined by successive partitions in an elongated vat.

6. A dyeing installation including apparatus according to claim 3 wherein said treatment zones comprise individual stages of a dyeing process.

7. Apparatus for the continuous treatment of textile material in endless form, comprising:

a generally U-shaped initial sealing chamber having one inlet end and an outlet end;

means to continuously pass the endless textile material into the inlet end of the initial sealing chamber;

a first textile treating chamber having an inlet end and an outlet end, the inlet end of said first textile treating chamber being in air-tight communication with the outlet end of said initial sealing chamber;

at least one intermediate U-shaped sealing chamber having an inlet end and an outlet end, the inlet end of said intermediate U-shaped sealing chamber being in air-tight communication with the outlet end of said first textile treating chamber;

a last textile treating chamber having an inlet end and an outlet end, the inlet end of said last textile treating chamber being in air-tight communication with the outlet end of the last of said at least one intermediate U-shaped sealing chambers;

a generally U-shaped final sealing chamber having an inlet end and an outlet end, the inlet end of said final sealing chamber being in air-tight communication with the outlet end of said last textile treating chamber;

an inert sealing liquid in said U-shaped sealing chambers;

means to continuously feed the endless textile material serially and alternately through said U-shaped sealing chambers and said textile treating chambers starting with said initial sealing chamber and ending with said final sealing chamber, said means to feed the endless textile material including means to propel the textile material through said U-shaped sealing chambers comprising: means to pass said sealing liquid through said U-shaped sealing chambers from the inlet end to the outlet end of each sealing chamber and then to the inlet of the next downstream sealing chamber, in series from said initial sealing chamber to and through said final sealing chamber and back to the inlet end of said initial sealing chamber; and means to continuously remove the endless textile material from the outlet end of said final sealing chamber.

* * * * *